US006712027B2

(12) United States Patent
Rocheleau

(10) Patent No.: US 6,712,027 B2
(45) Date of Patent: Mar. 30, 2004

(54) HOT WATER HEATING SYSTEM AND CONNECTOR FOR USE THEREWITH

(76) Inventor: John W. Rocheleau, 69 South Rd., Brentwood, NH (US) 03833

( * ) Notice: Subject to any disclaimer, the term of this patent is extended or adjusted under 35 U.S.C. 154(b) by 0 days.

(21) Appl. No.: 10/256,189

(22) Filed: Sep. 26, 2002

(65) Prior Publication Data

US 2003/0079697 A1 May 1, 2003

Related U.S. Application Data

(63) Continuation-in-part of application No. 09/981,376, filed on Oct. 16, 2001.

(51) Int. Cl.[7] ..... F24D 3/06

(52) U.S. Cl. ..... 122/235.15; 122/511; 237/8 A; 237/8 C

(58) Field of Search ..... 122/235.15, 235.21, 122/235.29, 360, 408.1, 411, 414, 511, DIG. 11; 110/325; 237/8 A, 8 B, 8 C; 137/552, 563

(56) References Cited

U.S. PATENT DOCUMENTS

| | | | | | |
|---|---|---|---|---|---|
| 3,873,022 | A | * | 3/1975 | Hilgemann | 237/8 R |
| 4,606,325 | A | * | 8/1986 | Lujan, Jr. | 122/13.3 |
| 4,750,472 | A | * | 6/1988 | Fazekas | 122/13.3 |
| 5,119,988 | A | * | 6/1992 | Fiedrich | 237/8 C |
| 6,053,416 | A | * | 4/2000 | Specht et al. | 236/75 |
| 6,220,520 | B1 | * | 4/2001 | Gibbs | 237/8 R |

* cited by examiner

*Primary Examiner*—Gregory Wilson
(74) *Attorney, Agent, or Firm*—Michael J. Persson; Lawson & Persson, P.C.

(57) ABSTRACT

A hot water heating system, coupler and integrated flow system. The hot water heating system includes a first isolator valve, a flow control valve, a circulator and a second isolator valve. Each of these components is equipped with one portion of a connector on one side of the component and a mating portion of a connector on the other side. The integrated flow system includes a body into which is attached at least a circulator and a flow control valve.

17 Claims, 16 Drawing Sheets

HOT WATER HEATING SYSTEM AND CONNECTOR FOR USE THEREWITH

CLAIM OF PRIORITY

This application is a Continuation-in-Part of co-pending U.S. patent application Ser. No. 09/981,376, filed Oct. 16, 2001.

FIELD OF THE INVENTION

The present invention relates to the field of connectors and, in particular, to connectors for hot water heating systems and heating systems utilizing these connectors.

BACKGROUND OF THE INVENTION

Hot water heating systems are alternatives to other conventional heating systems such as forced hot air, steam, and electric elements. The typical hot water heating system includes a boiler for heating water, a flanged pump for moving the heated water, a flow control valve, and any number of isolation valves that allow the components to be isolated from a supply pipe that transfers the heated water to a flexible heating pipe, radiator or convector. In addition, other mechanical devices that control and direct hot water flow through the system include fittings such as, 90 degree elbows, tees, and adapters, as well as air scoops and vents, manifolds, nipples, purge fittings and valves, tempering valves, balance valves, expansion tanks, backflow preventers, pressure reducing valves, etc., may also be included There are a number of current hot water heating systems utilizing the above mentioned components. One such heating system is a radiant floor heating system in which a flexible heating pipe is typically embedded throughout, or under, the floor of the room to be heated. Another is a hot water system utilizing radiators or convectors in which the hot water is fed to steel or copper fin tube baseboard, freestanding cast iron radiator units, or a fan convector coil. In each of these systems, once the hot water has flowed through the heating pipe, radiator or convector, the heated water continues through a return pipe back to the boiler for reheating, thus completing the loop.

One problem with current hot water systems is the time required to install them. Typically these piping systems use flanges, threaded fittings, black steel pipe, or sweat fit copper tubing, which is extremely labor intensive to install. Manufactured steel and copper piping or tubing come in straight runs and fittings for accommodating turns and curves. Each connector of a straight run with a fitting requires either a threaded or a sweat fitted solder connector and a substantial amount of installation labor is involved in making each joint.

In cases where threaded connectors are to be made, the pipe must be cut to the appropriate length, and then the threads must be cut on the end of the pipe using a pipe threading die. Next the threads must be dressed, cleaned and coated with a sealing compound, or a synthetic resinous fluorine tape, such as the product marketed by the duPont Corporation under the trademark TEFLON®, to prevent leaks. Finally, the connector must be screwed to the pipe end with sufficient thread contact to prevent leaks.

In the case of sweat fit solder joints, the labor is comparable in that the tubing must be cut to the proper length, the end of the tubing and the fitting must be dressed and fluxed and the joint must be heated to the proper temperature with a torch to effect a satisfactory solder joint. Once joined, the solder connection must then be cleaned of any residual flux that, if left un-cleaned, would corrode the joint once exposed to moisture.

In the case of flanged connections, such as those found on virtually all current circulators, the attachment is even more labor intensive. Circulator flanges are typically elliptical in shape and do not readily accommodate a standard pipe wrench or other tightening device. In addition, when the elliptical ends of the flange have turned within the 180 degrees tightening arc, the wrench must be readjusted, necessitating many fatiguing and time consuming iterations to complete the task. Moreover, as the size of a pipe wrench increases, the length of the handle increases proportionally. As pipe flanges must often be attached to a circulator that is extremely close to a wall, other pipes, or even worse, a corner, the use of a long handled pipe wrench or a pry-bar and long stove bolts to attach the flange to the pipe makes this job a tiring and time consuming one. Finally, once attached to the pipe, gaskets must be installed between the flanges and bolts secured to each flange to make the connections watertight. The inventor's pipe flange and sweat flange, described and claimed in U.S. patent application Ser. No. 09/179,584, and U.S. Pat. No. 6,283,157, respectively, ease this installation job somewhat. However, each still requires many of the same steps required for installing threaded or sweat copper connections, and each still requires the use of gaskets and bolts to secure the flanges to one another.

Another reason for the increase in installation cost is the fact that most systems are customized for the particular location in which they are to be installed. This requires that a variety of parts, having a variety of different connectors, be used to piece the system together. Further, careful attention must be paid to insure that all components are installed in the correct position relative to the flow direction of the heating water. Because of this, current systems must be installed by trained professionals who have the tools and the know-how to properly assemble such customized systems.

Finally, the replacement of failed components in current systems requires that pipes be cut, rusted bolts be removed, worn gaskets be replaced, etc. This, again, increases the complexity of the work to be performed and mandates that trained professionals undertake any repair work on current systems.

Therefore, there is a need for a hot water heating system that is easily adapted for a variety of applications, that employs fewer joints requiring sealing compounds, solder, gasketing materials, or expensive tools to install than conventional systems, that insures that all components are in the proper position relative to water flow direction, and that allows failed components to be quickly and easily replaced without the need for professional assistance.

SUMMARY OF THE INVENTION

The present invention is a hot water heating system, coupler and integrated flow system that overcome the drawbacks of traditional systems.

The system of the present invention utilizes male and female connectors for all main heating system components and, allows the system to be completely installed using no more than two ordinary wrenches. In its most basic form, the system of the present invention includes a first isolator valve, a flow control valve, a circulator and a second isolator valve. Each of these components is equipped with one male portion of a connector on one side of the component and one female portion of a connector on the other side of the component, such that, for example, all inflow sides utilize male portions of connectors and all outflow sides utilize female of connectors portions, or vice-versa. These union connectors are sized to allow the components to be quickly and easily attached together in the proper orientation relative to one another. Further, the systematic nature of the components, i.e. male on one side and female on the other side, prevents the inadvertent installation of any component in the wrong flow direction.

In some embodiments, fittings, nipples, pipe, and adapters may be required to assemble the components so that hot water may flow throughout the heating system. In addition, an expansion tank, backflow preventer, and pressure reducing valve may be required to maintain the desired pressure in the system at all times.

In embodiments of the system utilized with radiant manifolds and radiant heat emitters, the present invention also includes an air vent, a flow control valve, a tempering valve, and a tee connector with a temperature gauge or temperature-sending unit. Each of these components is equipped with union connectors arranged in the same manner, i.e. the male on inflow side/female on outflow side configuration, as described above.

In embodiments of the system utilized with hot water radiator type heating systems, the present invention includes an air scoop in addition to the first isolator valve, flow control valve, circulator, and second isolator valve. As was the case above, each of these components is equipped with union connectors arranged in the same manner, i.e. the male on inflow side/female on outflow side configuration.

In one preferred embodiment of the invention, a system is sold as a kit of parts having all necessary components and branch connectors to install the system. In such a kit, all components will be fitted with male and female connectors and each may be readily installed together utilizing no more than two wrenches.

The present invention also encompasses a connector system for coupling a first component and a second component of a hot water heating system. The connector system includes a nipple having a locking notch and a sealing notch disposed thereon and a union coupler. The union coupler includes a sealing means dimensioned to mate with the sealing notch of the nipple and creating a watertight seal between the nipple and the union coupler. The coupler also includes a union body having a substantially hollow cylindrical cross section forming an outer wall and an inner wall, at least one notch for accepting the sealing means, and at least one slot disposed through the outer wall and the inner wall to form at least one opening across a circumference of the union body. The notch is disposed a distance from the at least one slot that is substantially identical to a distance between the sealing notch and the locking notch of the nipple. Finally, the union coupler includes a union clamp having a substantially hollow cylindrical cross section forming an outer wall and an inner wall having a diameter that is larger than a diameter of the outer wall of union body. The union clamp includes a slit through its outer wall and inner wall of sufficient width to allow the inner diameter of the ring to be adjusted, a means for retaining the union clamp in place relative to the union body, and at least one locking detail dimensioned for disposal within the at least one slot through the union body such so as to engage the locking notch of the nipple and prevent the nipple from moving relative to the union coupler.

Finally, the present invention also encompasses an integrated flow system that includes a unitary body having an inflow end, an outflow end, a volute opening and a flow control valve opening disposed between the inflow end and the outflow end. A circulator is attached to the volute opening and a flow control valve attached to the flow control valve opening. In some such embodiments, a pair of isolator valves are attached to valve openings formed proximate to the inflow and outflow ends of the body. Still other such embodiments include a tempering valve and temperature gauge that are disposed within other central openings in the body.

Therefore, it is an aspect of the invention to provide a hot water heating system that is easily adapted for a variety of applications with minimal labor to install.

It is a further aspect of the invention to provide a hot water heating system that employs fewer joints requiring sealing compounds, solder, gasketing materials, or expensive tools to install than conventional systems.

It is a further aspect of the invention to provide a hot water heating system that insures that all components are in the proper position relative to flow direction.

It is a further aspect of the invention to provide a hot water heating system that allows failed components to be quickly and easily replaced without the need for professional assistance.

These aspects of the invention are not meant to be exclusive and other features, aspects, and advantages of the present invention will be readily apparent to those of ordinary skill in the art when read in conjunction with the following description, appended claims and accompanying drawings.

DETAILED DESCRIPTION OF THE INVENTION

Figure 1:
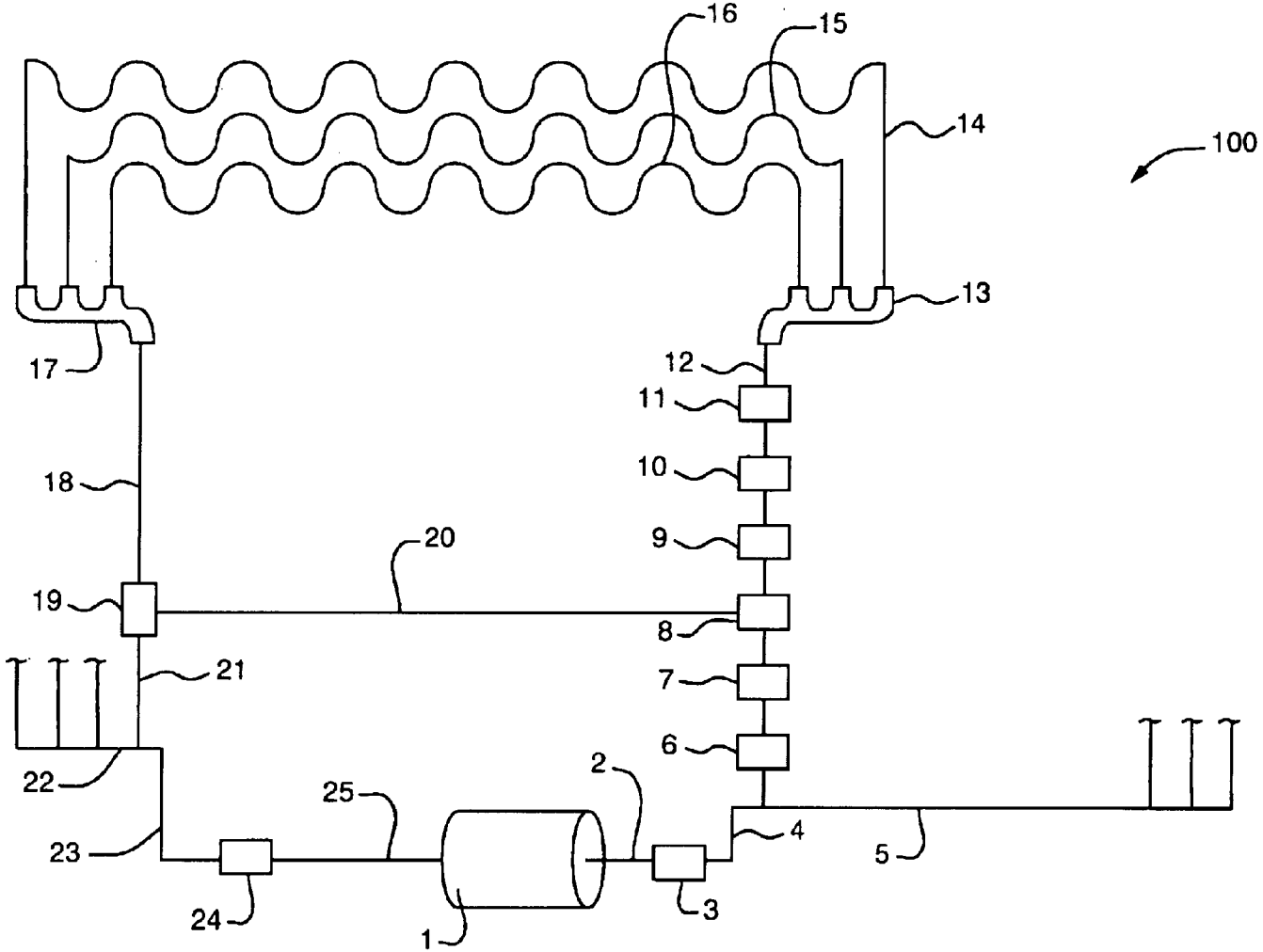
FIG. 1 is a diagrammatic view of a radiant hot water heating system.

FIG. 1 is a diagrammatic representation of a radiant hot water heating system 100. Boiler 1 produces a hot liquid; typically water, which is transported through the system 100 by means of circulator 10. After leaving the boiler 1 the liquid enters connection pipe 2 and flows into micro-bubble air vent 3 where the liquid is de-gassed. The liquid then flows via connection pipe 4 into a zone distribution manifold 5. It is noted that a system 100 such as this will typically have two or more zones but, for clarity, only one zone is detailed in the FIG. 1.

After leaving the zone distribution manifold 5, the liquid flows in series through a first isolator valve 6, flow control valve 7, tempering unit 8, tee connection mounted temperature gauge 9, circulator pump 10, and a second isolator valve 11. After leaving the second isolator valve 11, the liquid flows through connection pipe 12 into the radiant tube distribution manifold 13.

The radiant tube distribution manifold 13 divides the liquid flow into a plurality of radiant tubes 14, 15 and 16 respectively. Three radiant tubes 14, 15 and 16 are shown purely as an example, and the number of tubes used in an actual system is dependent on the size and shape of the area to be heated as well as the desired emission region, e.g., from the floor. The liquid passes through the radiant tubes 14, 15 and 16 and then enters the radiant tube return manifold 17 where it is reunited as a single liquid flow.

The liquid leaves radiant tube return manifold 17 via return pipe 18 and flows into tee connection 19. A portion of the liquid flow exits tee connection 19 via tempering feedback pipe 20 and flows into tempering unit 8, where it is used to reduce the temperature of the heated water from the boiler 1 to a desired temperature. This tee connection 19 may also include all male and female portions of union connectors, or it may include a combination of union connectors and other conventional connectors, such as solder connector, barbed connectors, threaded connectors or the like. The remainder of the liquid flow exiting the tee connection 19 flows into the zone return manifold 22 via connection pipe 21. The liquid flow then leaves zone return manifold 22 via connection pipe 23 and flows past purge valve 24 when purge valve is closed and through connection pipe 25 into boiler 1, effectively completing the flow circuit.

Figure 2:
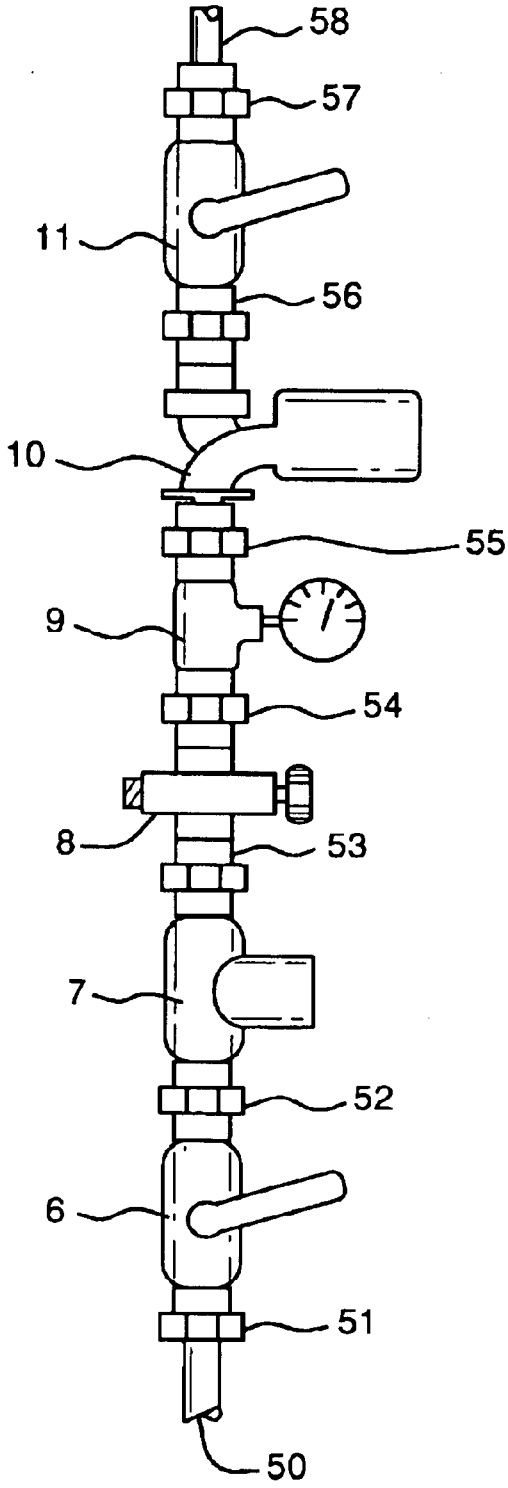
FIG. 2 is a view of the component and union connector arrangement for a radiant hot water heating system.

FIG. 2 shows the first isolator valve 6, flow control valve 7, tempering unit 8, tee connection mounted temperature gauge 9, circulator pump 10, and second isolator valve 11 of the radiant hot water heating system 100 of FIG. 1, and their arrangement with connectors 51, 52, 53, 54, 55, 56 and 57. The connectors 51, 52, 53, 54, 55, 56 and 57 shown in this embodiment are union type connectors. However, as described below, certain other types of connectors may be utilized to achieve the desired result.

In the embodiment of FIG. 2, union connector 51 joins isolator valve 6 to upstream heating components, for example to a connection pipe 50 as shown. Union connector 52 joins isolator valve 6 to flow control valve 7. Union connector 53 joins flow control valve 7 to tempering unit 8. Union connector 54 joins tempering unit 8 to tee connection mounted temperature gauge 9. Union connector 55 joins tee connection mounted temperature gauge 9 to circulator 10. Union connector 56 joins circulator 10 to isolator valve 11. Union connector 57 joins isolator valve II to downstream heating components, for example to a connection pipe 58 as shown.

Figure 6:
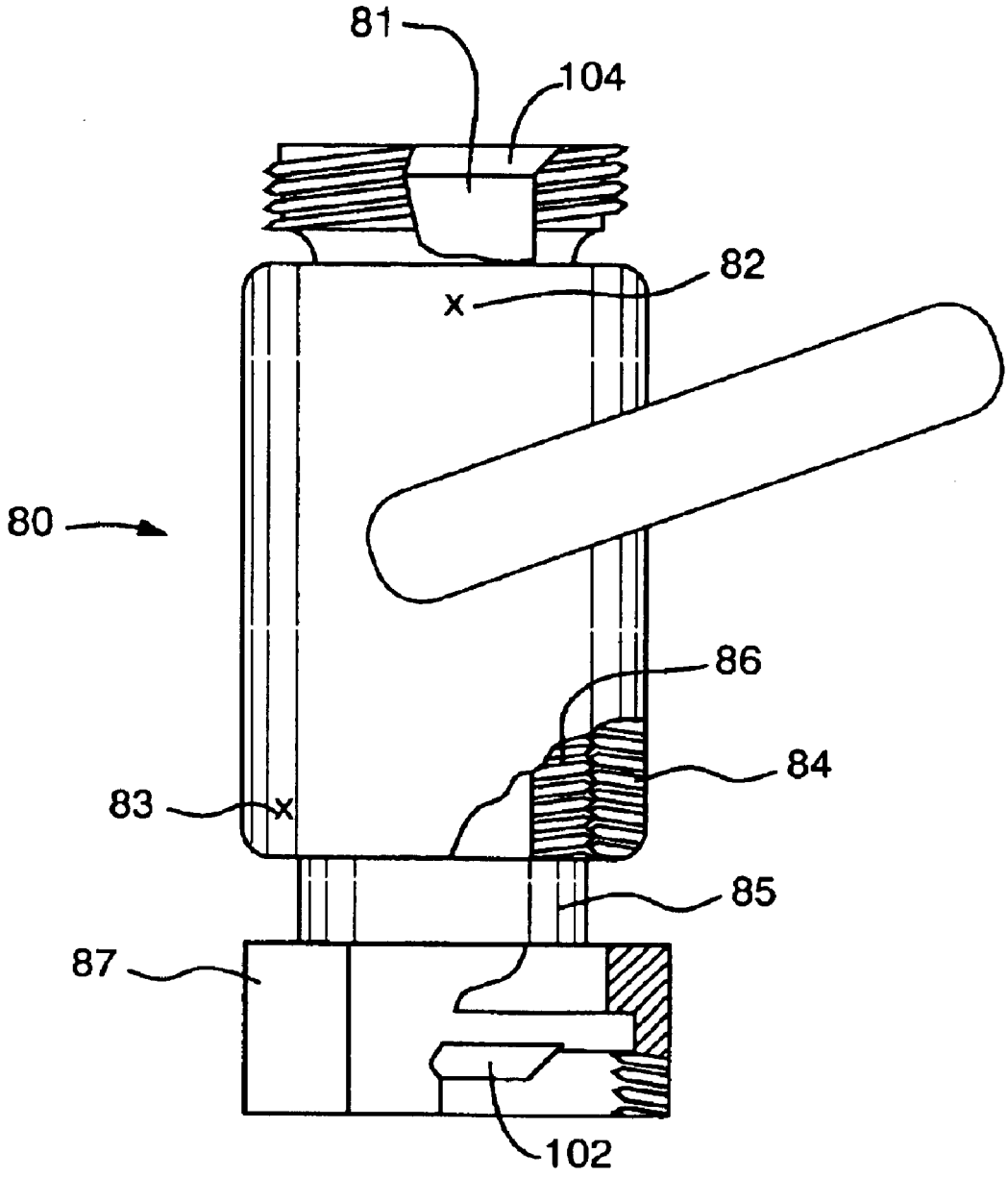
FIG. 6 is a partial cut-away view of a component and union connector assembly with the female union connector integral with component and the male union connector threaded into the component.
Figure 7:
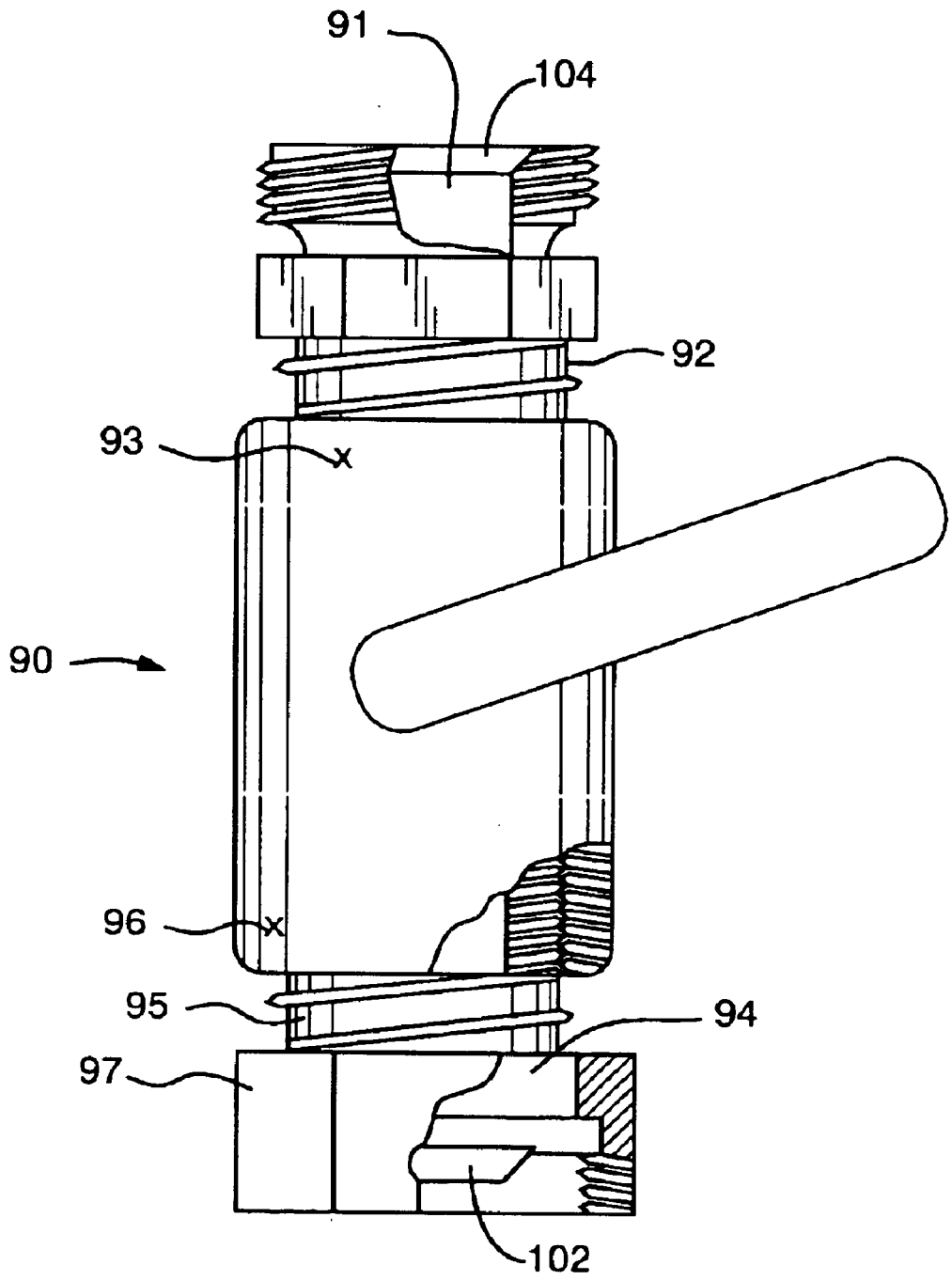
FIG. 7 is a partial cut-away view of a component and union connector assembly with nipple sections joining the male and female union connectors to the component.

In the arrangement shown in FIG. 2, each component 6, 7, 8, 9, 10 & 11 has a male portion of a union connector at one end and a mating female portion of a union connector a the opposite end, similar to the arrangement shown in detail in FIGS. 6 & 7. This allows the male portion of one component to easily connect to the female portion of an adjacent component, effectively forming union connectors 51, 52, 53, 54, 55, 56 and 57 between each. It is noted that the male and female portions of the connectors 51, 52, 53, 54, 55, 56 and 57 need not be on any specific end, but that all upstream ends should have the same male or female portion and, likewise, all downstream ends should have an opposite portion. Thus, by identifying the flow direction on a single component; the circulator 10, for example, all other components will necessarily be installed in their proper orientation.

Figure 3:
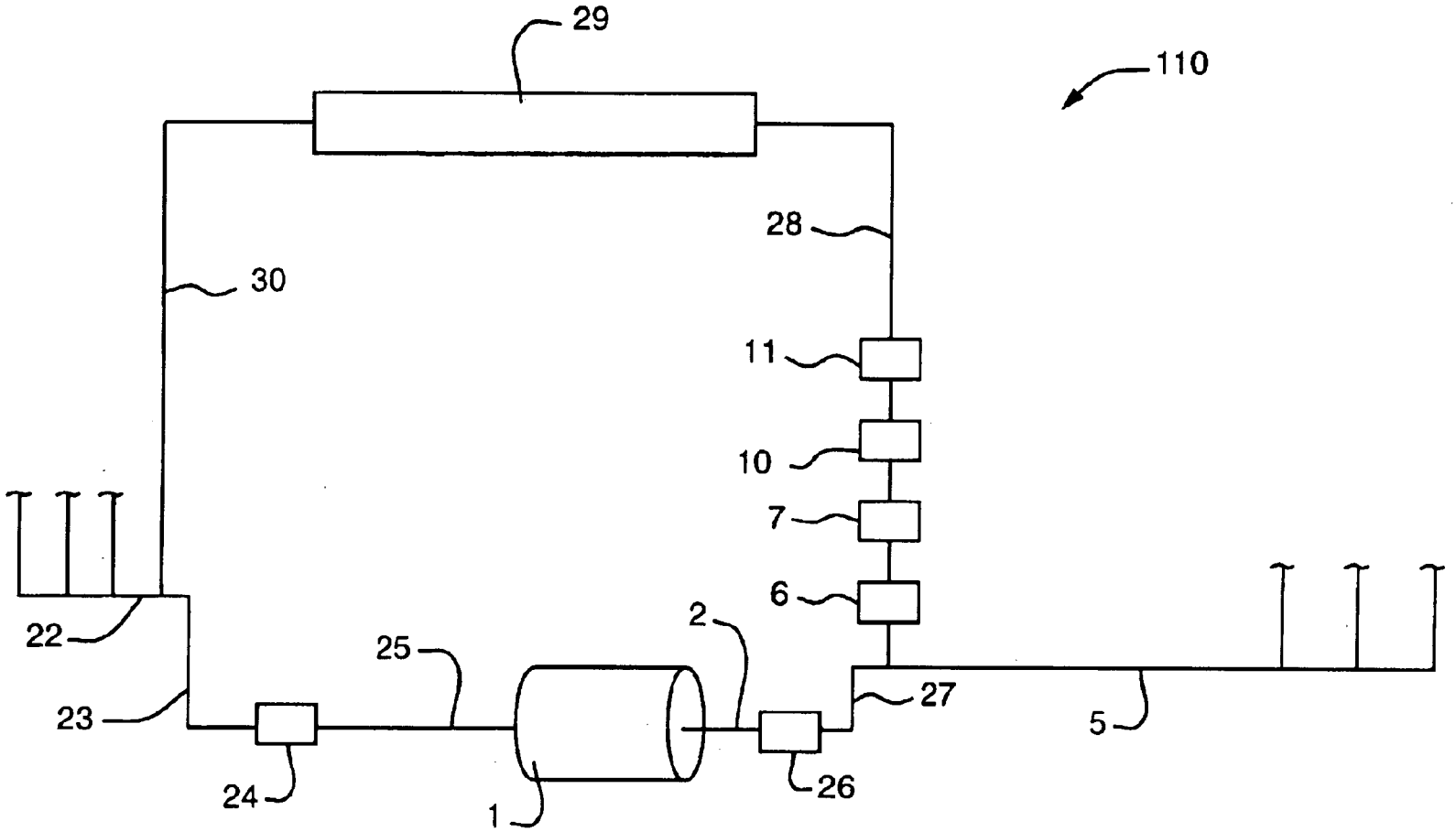
FIG. 3 is a diagrammatic view of a radiator type hot water heating system.

FIG. 3 is a diagrammatic representation of an alternate embodiment of the invention as applied to a radiator type hot water heating system 110. As with the radiant hot water system 100 of FIG. 1, boiler 1 produces a hot liquid, which is transported through the system by means of circulator 10. After leaving the boiler the liquid enters connection pipe 2 and flows into air scoop 26 where the liquid is degassed. This air scoop 26 performs essentially the same function as the microbubble air vent 3 of the radiant system 100, but is less expensive than the microbubble air vent 3 and provides sufficient degassing in a radiator type hot water system 110.

After it has been degassed, the liquid then flows via connection pipe 27 into a zone distribution manifold 5. As was the case with the radiant system 100 described above, a system 110 such as this will typically have two or more zones, but only one zone is detailed in the FIG. 2. After leaving the zone distribution manifold 5 the liquid flows in series through a first isolator valve 6, flow control valve 7, circulator 10, and a second isolator valve 11.

After leaving the second isolator valve 11, the liquid flows through connection pipe 28 and into baseboard radiator 29. It is noted that a baseboard type radiator is used purely as an example but other varieties of liquid-to-air, liquid-to-liquid or liquid-to-solid heat exchangers could also be used with the present invention. The liquid flows from baseboard radiator 29 via connection pipe 30 and enters zone return manifold 22. The liquid flows from zone return manifold 22 to purge valve 24 via connection pipe 23. The liquid leaves purge valve 24 through the connection pipe 25 and returns to boiler 1 completing the flow circuit.

Figure 4:
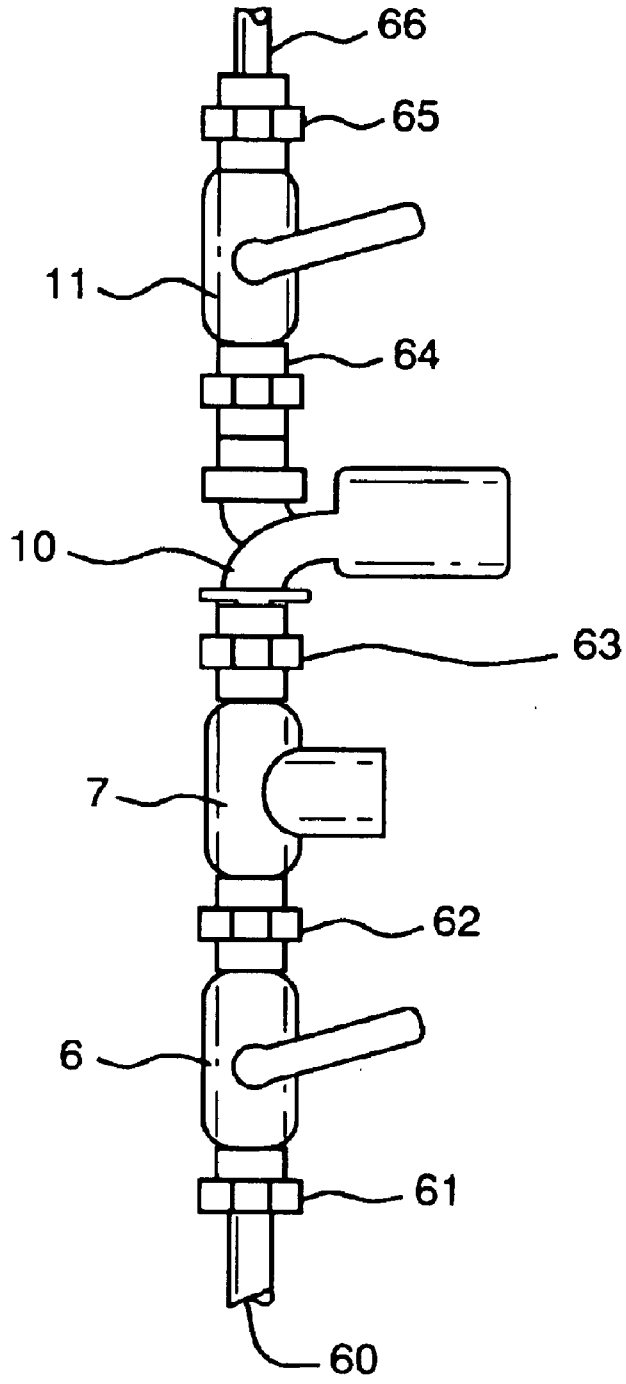
FIG. 4 is a view of the component and union connector arrangement for a radiator type hot water heating system.

FIG. 4 shows the first isolator valve 6, flow control valve 7, circulator pump 10, and second isolator valve 11 of a baseboard radiator heating system 110 and their arrangement with connectors 61, 62, 63, 64 and 65. As was the case with FIG. 2, the connectors shown in FIG. 4 are union type connectors, but certain other types of connectors may be utilized to achieve the desired result.

In the embodiment of FIG. 4, union connector 61 joins isolator valve 6 to upstream heating components; for example to a connection pipe 60 as shown. Union connector 62 joins isolator valve 6 to flow control valve 7. Union connector 63 joins flow control valve 7 to circulator 10. Union connector 64 joins circulator 10 to isolator valve 11. Union connector 65 joins isolator valve 11 to downstream heating components, for example to a connection pipe 66 as shown.

Figure 5:
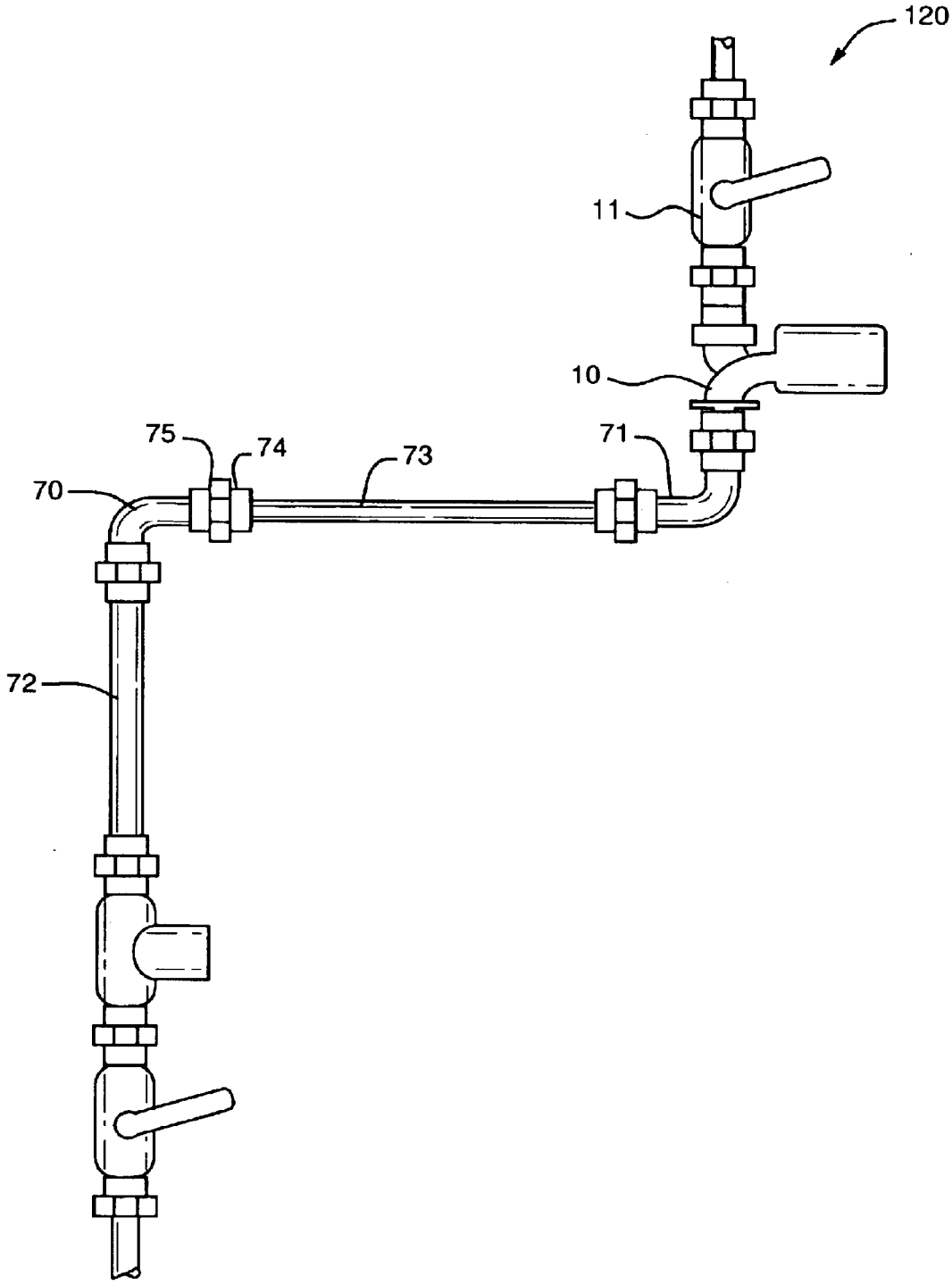
FIG. 5 is a view of the component and union connector arrangement for a radiator type hot water heating system with the use of an offset connector.

FIG. 5 shows one variation of the system 110 of FIG. 3 in which the components are not disposed in line with one another. In this system 120, a plurality of offset connectors, here a pair of 90° elbows 70 and 71 and an extension pipes 72 and 73 each fitted with male 74 and female 75 portions of connectors, are used to offset the system sideways. The ability to offset the system is important due to space considerations and obstacles that are found in particular installations. Therefore, although this system 120 is shown as only including a pair of ninety degree elbows 70 and 71 and extension pipes 72 and 73, it is envisioned that other systems and kits will include a plurality of offset connectors, including tees, forty-five degree elbows, union to copper or union to threaded adaptors, nipples, or the like.

It is envisioned that the components that make up the various systems may be sold in kit form, which would include all of the necessary components and offset connectors to accommodate any installation. As was the case with the system, at least the main system connectors, i.e. connectors between the isolator valves, the circulator and flow control, will each have male and female portions that quickly mate together in the proper flow direction. However, it is likewise recognized that there may be some parts, such as the connectors from the boiler, or the return to the tempering valve in the radiant hot water system, that utilize connectors other than connectors disposed upon the circulator and valves and, therefore, all embodiments of the present invention should not be so limited.

In the preferred embodiments of the system and kit, the female portions of union connectors are integral to the components themselves. An example of an isolator valve 80 having such integral connectors is shown in FIG. 6. In such an arrangement, the female union connector 81 is formed integral to the second end 82 of the body of valve 80 during the manufacture of the valve 80, while the first end 83 of the body of valve 80 includes female threads 84 to which the male connector 85 is attached. As shown in FIG. 6, the male portion of the connector 85 in this embodiment includes a threaded end 86 that threads into the female threads 84 in the first end 83 of the body of valve 80 and captures a nut 87 that mates with the threads of the female connector of an adjacent component (not shown).

Although the components of the preferred embodiments have been described as having integral female connectors, it is also recognized that utilizing standard components and fitting them with the desired portions of the male and female connectors may achieve similar results. This may be accomplished by adding nipples or other adaptors to the male and female portions of the connectors to allow them to mount to existing components, or it may involve the machining of specialized adaptors that include integral male or female portions of the connectors. An example of an embodiment using nipples is shown in FIG. 7, which shows an isolator valve 90 joined to a female portion of a union connector 91 via a threaded nipple 92, which is threaded into the second end 93 of the body of valve 90. The male portion of the union connector 94 is joined to isolator valve 90 via a threaded nipple 95, which is threaded into the first end 96 of the body of valve 90 and thus capturing nut 97.

Figure 8C:
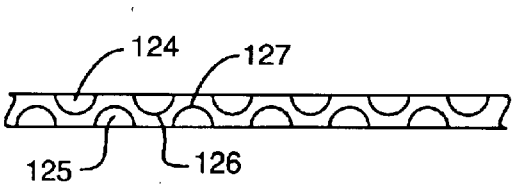
FIG. 8C is an exploded view of the self-locking feature of the union nut of FIGS. 8A and 8B with both halves in a locked position.
Figure 8B:
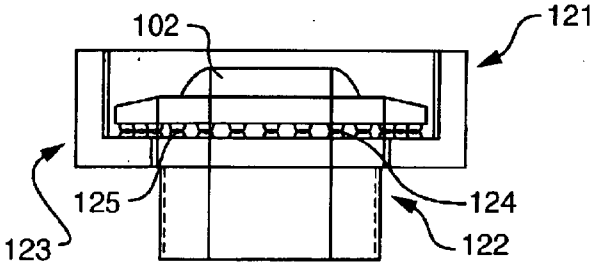
FIG. 8B is a cut away side view of the nut of FIG. 8A with the two halves brought together during assembly.
Figure 8A:
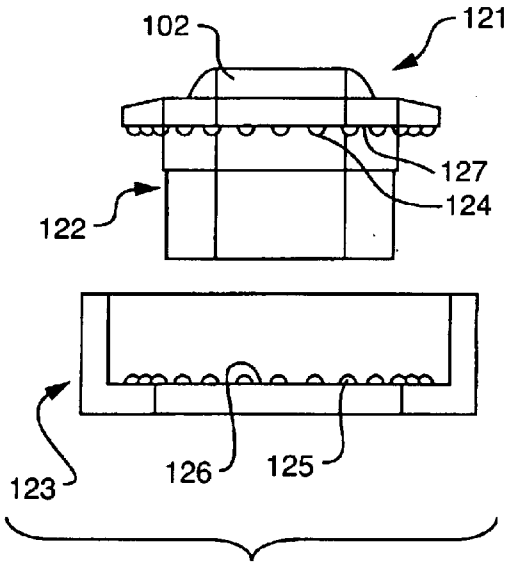
FIG. 8A is a cut away side view of two halves of male portion of a hand tightenable self-locking union nut in position for assembly.

Referring now to FIGS. 8A–8C, an improved male portion 121 of a union connector that is both hand-tightenable and self-locking is shown. As was the case with the other male portions of connectors described above, the male portion 121 includes a first portion 122 having a male sealing surface 102 that is dimensioned to mate directly with a female sealing surface of an adjacent component (not shown) and a nut 87 that is dimensioned to mate with the threads of the female connector of an adjacent component (not shown). However, the male portion 121 includes a plurality of locking details 124, 125 disposed upon the mating surfaces between the first portion 122 and the nut 87 and dimensioned to interlock to prevent unintended rotation of the nut 87 after installation.

As shown in FIGS. 8A–8C, the locking details 124, 125 are a plurality of bumps or ridges that are separated by spaces 126, 127 that are dimensioned to accept the locking details 124, 125 when the nut 87 is tightened to the adjacent component. However, it is recognized that a single set of bumps on one portion in frictional relationship with a planar surface on another portion provide sufficient frictional engagement to prevent rotation. It is also recognized that locking details 124, 125 having different cross sections, such a serrations or the like, may be substituted to achieve similar results. Finally, it is noted that the preferred version of the male portion 121 of FIGS. 8A–8C is manufactured of cross linked polyethylene (PEX). However, other embodiments may be manufactured of brass, high temperature plastic or other art recognized materials to achieve similar results.

The sealing surfaces of the union connectors shown in the preceding figures are conventional, in that the sealing surface of the female portion of the connector, commonly referred to as the "seat", mates directly with a corresponding sealing surface on the male portion of the connector of an adjacent component without an intermediate component, such as a gasket, to aid sealing. Referring specifically to FIG. 6, the male sealing surface 102 would mate directly with a female sealing surface (analogous to 104 of isolator valve 80) when assembled with an adjacent component (not shown). Another embodiment of the invention, utilizing a female portion of a union connector having a different type of seat, is shown in FIG. 9.

Figure 9:
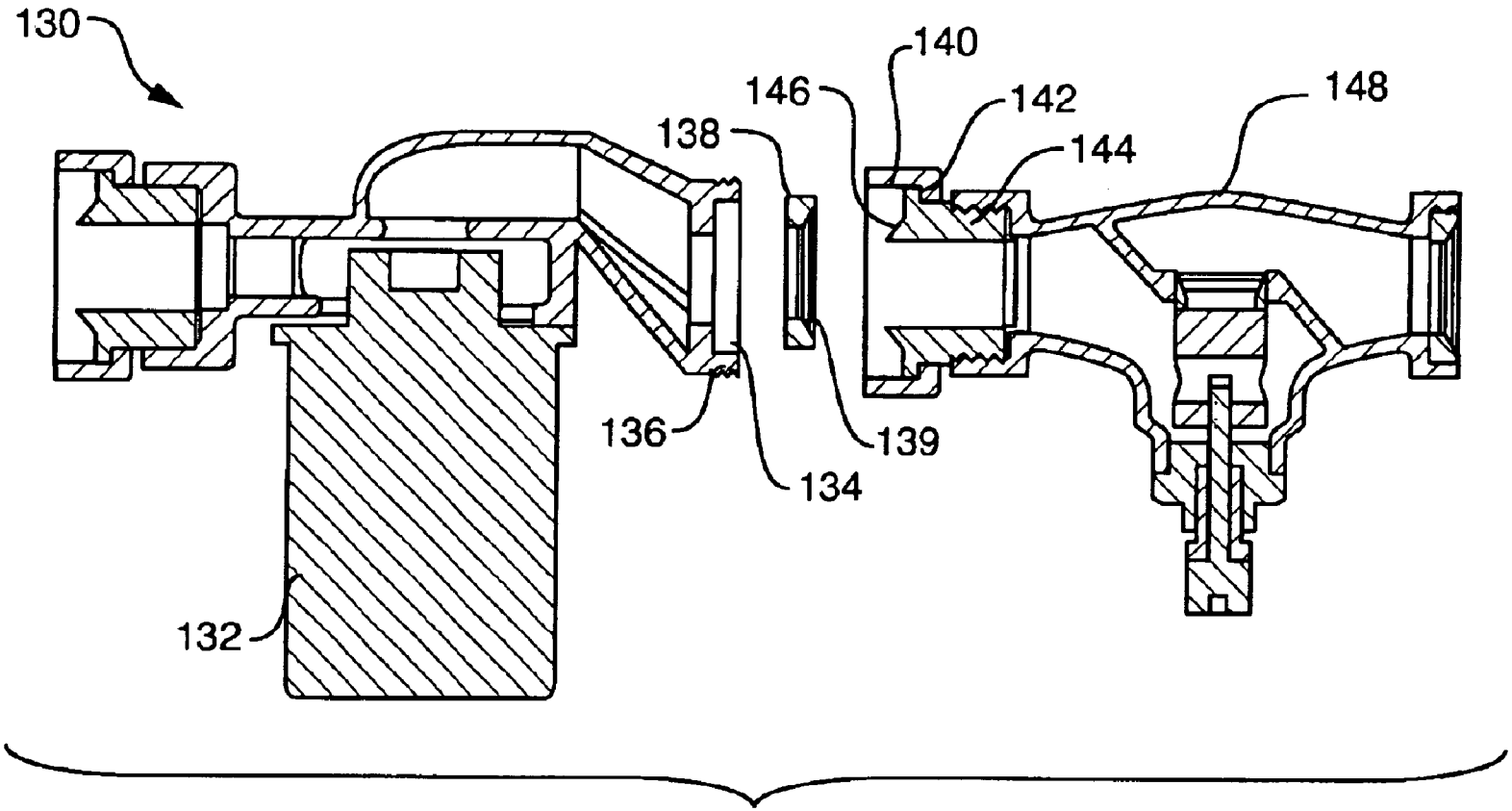
FIG. 9 is an exploded cross sectional view of a volute circulator and a flow control valve assembly using a union connector with an inserted seat component.

FIG. 9 shows an exploded cross sectional view of assembly 130 comprising a circulator 132, an insert 138 and a flow control valve 148. Assembly is accomplished by placing insert 138 in cavity 134 of circulator 132, threading union nut 142 onto external thread 136, and tightening the union nut 142, either by hand or using a tool such as a wrench of appropriate size. The tightening of union nut 142 onto external thread 136 causes insert 138 to be compressed between cavity 136 and male union connector 144 thereby providing a leak tight seal.

In the embodiment shown in FIG. 9 the insert 138 is provided with a conical sealing surface 139, which mates with a corresponding conical sealing surface 146 on male union connector 144. However, one of ordinary skill in the art would recognize that other sealing surface geometries could be employed, such as, but not limited to; flat mating surfaces, one or more circular ridges of triangular cross section mating with one or more circular troughs of corresponding triangular cross section, one or more circular ridges of semi-circular cross section mating with one or more circular troughs of corresponding semi-circular cross section, etc.

In the preferred embodiment the insert is made of TEFLON®, or other synthetic resinous fluorine. However one of ordinary skill in the art would recognize that other materials could be substituted to provide the same sealing function, such as urethane, BUNA®, rubber, silicone rubber, polyethylene, polycarbonate, VITON®, etc. In the preferred embodiment the deformability of the TEFLON®, under compression between the union nut 142 and the male portion 144 of the union connector aids in both assembly and sealing. The TEFLON® deforms locally to accommodate minor imperfections in the male portion 144 of the union connector and the cavity 136 to provide a leak tight seal. Significant strain energy can be stored in the deformed TEFLON® insert with relatively low compression forces, and correspondingly low tightening torques, by replacing the nutlike exterior features of the union nut 142 with details to mate comfortably with the human hand. Such an arrangement may take many forms, such as the knurls commonly used on bicycle carriers and the like, which make it possible to tighten the union nut 142 without the use of tools and still accomplish a leak-tight seal. A knurled type union nut would preferably also be dimensioned externally to accept a wrench, as well allowing the installer to optionally tighten it with a wrench if the application requires the sealing of pressures beyond the capability of hand tightening, or if the installer wishes to create a tighter seal.

Although FIG. 9 shows components having the male portion 144 of the union connector located on the outflow side of the component and the female portion of the union connector located on the inflow side of the component, one of ordinary skill in the art would recognize that this relationship could be reversed. As explained earlier with reference to FIG. 2, in the preferred embodiments of the system, the inflow ends of all components to be joined be equipped with the same gender connector portion, either male or female, and that the outflow ends of the components be equipped with the opposite type of connector portion. Such an arrangement precludes the assembly of components in the wrong orientation; i.e. outflow end mated to outflow end or inflow end mated to inflow end. However, as described with reference to the quick disconnect connectors of FIGS. 10–14, other embodiments may include components having the same gender connector portion at both ends, with each component being connected to an adjoining component via a dual connector having mating details at both ends. In these embodiments, the ease of assembly that is an advantage of the basic system is maintained, but it is recognized that the components must be clearly marked with proper flow direction in order to prevent installation in an improper orientation.

Figure 10:
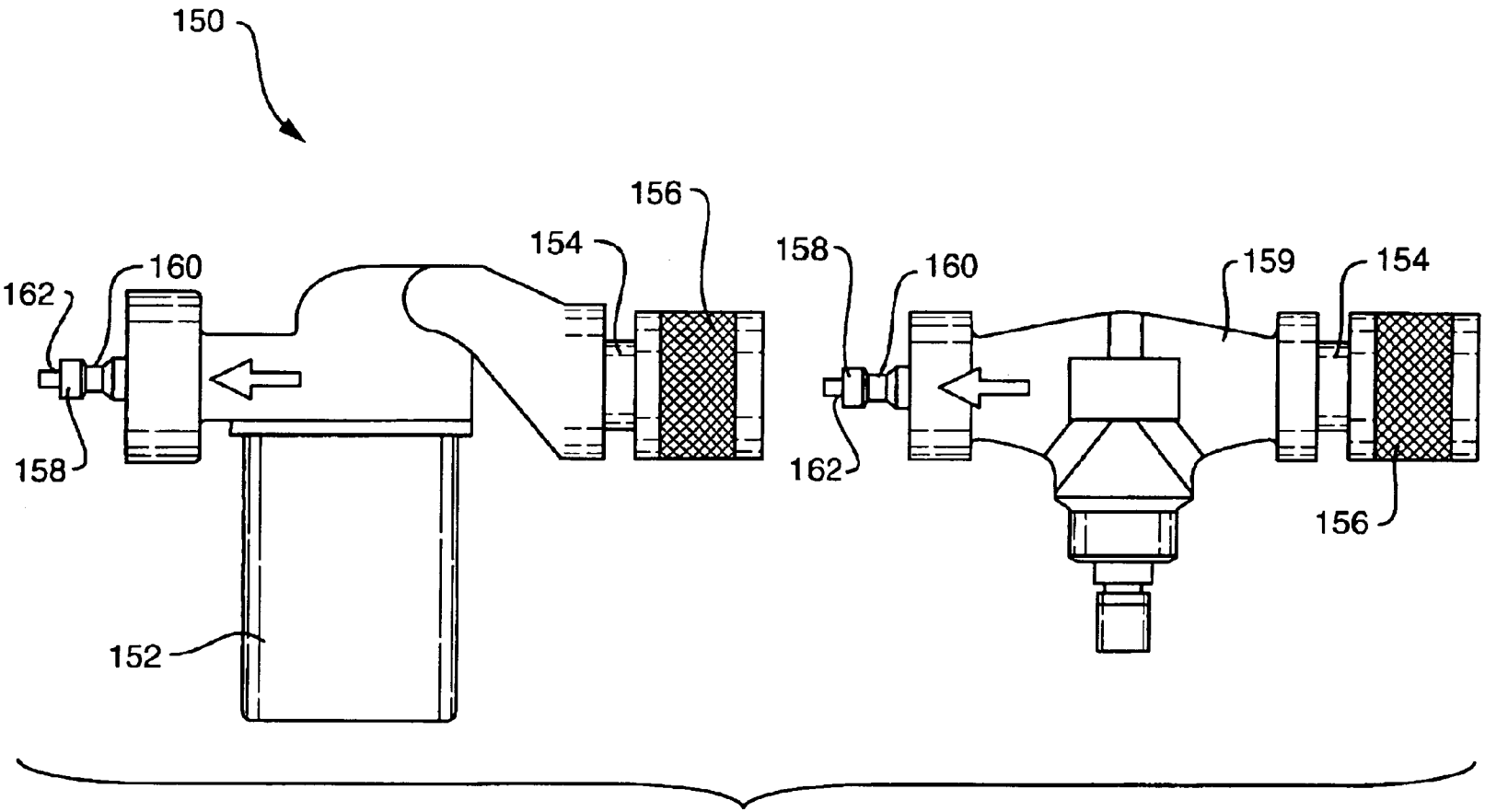
FIG. 10 is an exploded view of a volute circulator and flow control valve assembly using a quick connect-disconnect type coupling.

FIG. 10 shows another embodiment of the present invention. An exploded view of assembly 150 is shown. Assembly 150 includes a circulator 152, and a flow control valve 158. Circulator 152 and flow control valve 158 are joined using a quick connect-disconnect type coupling commonly used in pneumatic, hydraulic and water flow applications and marketed by Parker Hannifin, Quick Coupling Division, Minneapolis, Minn. The circulator 152 is equipped with male coupling barb 158 on its outflow end and a female coupling receptacle 154 on its inflow end. The flow control valve 159 is similarly equipped with male coupling barb on its outflow end and a female coupling receptacle 154 on its inflow end. Assembly is accomplished by retracting lock rings 156 and inserting barb into female coupling receptacle 154. Upon insertion, seal land 162 mates with a seal (not shown) within the female coupling receptacle 154, making a leak-tight seal between the barb 158 and female coupling receptacle 154. The lock ring 156 is then released, causing locking balls (not shown) to seat in locking balls trough 160 thus preventing removal of barb 158 from female coupling receptacle 154.

Although not shown in FIG. 9 or 10, a secondary locking means could be employed to prevent accidental displacement of the sealed connectors after assembly. One of ordinary skill in the art would recognize many means by which secondary locking could be accomplished. Examples, of such means well known in the art are; the use of a clevis pin (not shown) which when installed engages a secondary locking trough (not shown) in the female coupling receptacle in a position adjacent to the lock ring or union nut such that the lock ring or union nut is prohibited from retracting; a jam nut (not shown) in threaded engagement with the female coupling receptacle which, when tightened, prohibits the union nut from retracting, the application of a self ratcheting wire tie behind the locking ring prohibiting the lock ring from retracting, a set screw, etc.

Although FIG. 10 shows components having the barb 158 located on the outflow side of the component and the female coupling receptacle 154 is located on the inflow side of the component, as explained earlier, one of ordinary skill in the art would recognize that this relationship could be reversed.

Figure 11:
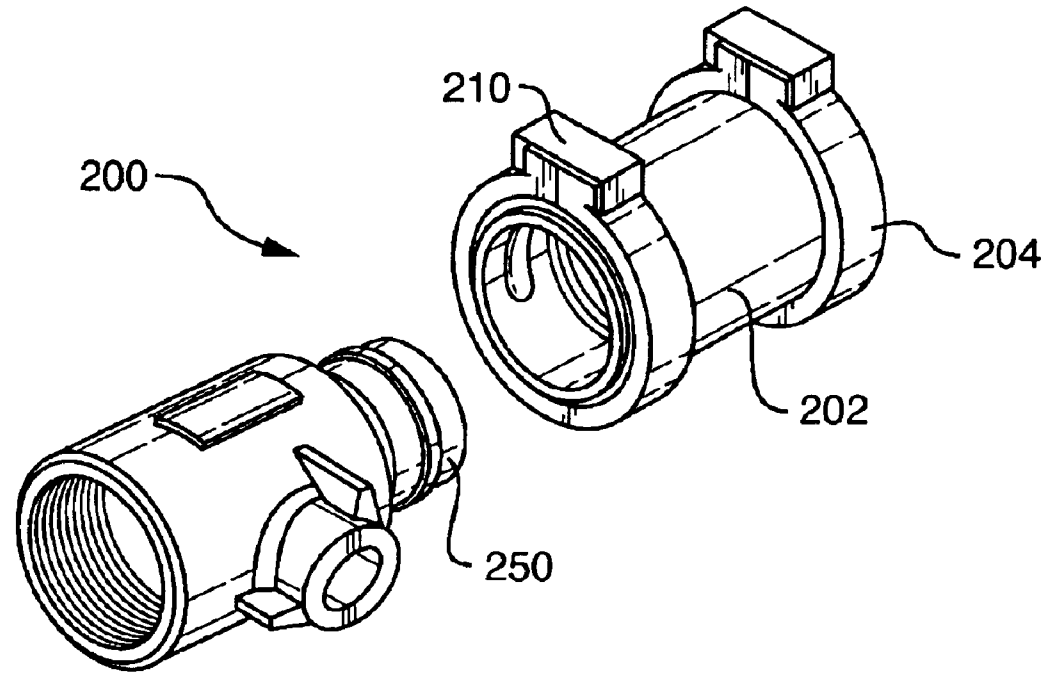
FIG. 11 is an isometric assembly view of the preferred quick coupling system of the present invention.
Figure 12:
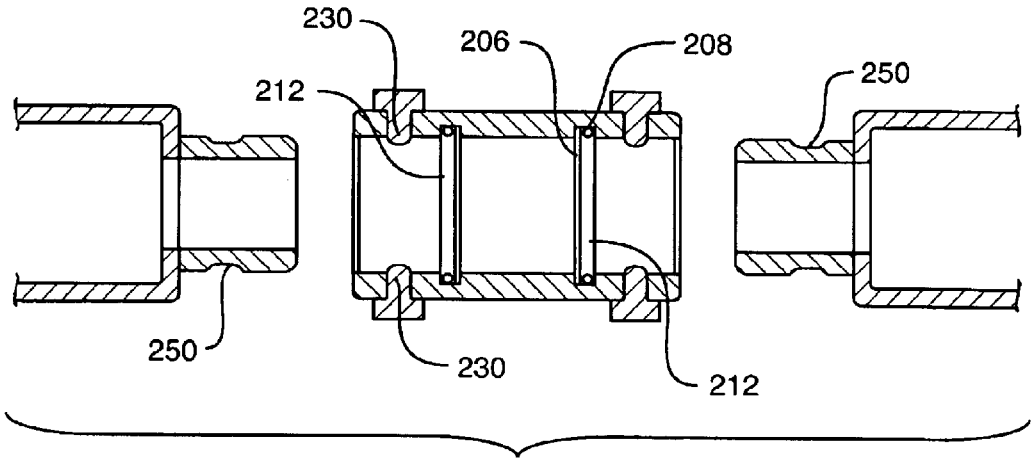
FIG. 12 is a cross sectional view of a union body, union clamp and a pair of nipples of the preferred quick coupling system of the present invention.
Figure 13:
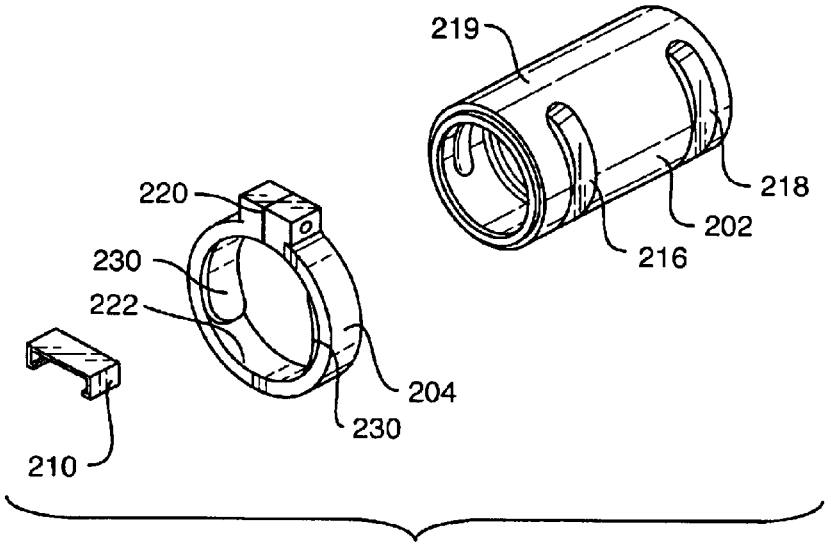
FIG. 13 is an isometric assembly view of the union body, union clamp and union clip of the preferred quick coupling system of the present invention.

The preferred coupling system is shown in FIGS. 10–12. This preferred coupling system 200 includes a union coupler 201, made up of a union body 202, a union clamp 204, a union back-up ring 206 and a union o-ring 208, and a nipple 250 attached to a flow component and dimensioned to mate with the union body 202. In addition, the preferred coupling system includes a means for retaining the union clamp 24 in place relative to the union body 202. As shown in FIGS. 10–12, this means is a union clip 210, which exerts a spring force upon the union clamp 24, which tends to hold the clamp 204 in position. However, in other embodiments the means includes a bolt (not shown) that is dimensioned to mate with a threaded opining in the union clip 210 and tightened to draw the clamp 204 together and hold it in position.

The union body 202 is substantially cylindrical in cross section and includes a pair of notches 212 dimensioned to accept the back-up ring 206 and the o-ring 208. In addition, the union body includes two pairs of slots 216, 218, which are dimensioned to accept union clamp 204.

The union clamp 204 is a substantially cylindrical ring having a slit 220 therethrough of sufficient width to allow the inner diameter of the ring to be adjusted. The inside surface 222 of the clamp 204 is dimensioned to mate with the outer surface 219 of the union body 202 and includes two locking details 230 that extend across the sides of the inside surface 222. In the preferred embodiment, these locking details 230 are substantially cylindrical posts that are dimensioned for disposal within the pairs of slots 216, 218 on the outer surface 219 of the union body 202. However, in other embodiments, the locking details 230 may have other cross-sections or be formed integral to the sides of the inner surface 222 of the clamp 204.

In the preferred embodiment, the union body 202 and union clamp 204 are manufactured of a high temperature plastic that is easily moldable, affordable, may be manufactured in a variety of colors. The ability to manufacture these components from these materials offers a significant cost advantage over existing systems and, therefore, these materials are preferred. However, it is recognized that the union body 202 and union clamp 204 may be manufactured from other art recognized materials, such as brass, steel, iron or the like, to produce similar results.

In this system 200, the nipple is preferably attached to both ends of the flow components and these components are joined using a union coupler 201 between each component. This method is preferred as it is easier to manufacture a pair of nipples 250 at each end and manufacture union bodies 202 and clamps 204 separately. However, it is understood that the ends of the components may be female portions of the connector, with the coupler being made of a pair of nipples. Further, the same concepts described above with regard to having a male portion at one end and a female portion at the other are also applicable to system 200, and the same advantages attendant to this arrangement would likewise apply to the system 200. Finally, the nipples 250 will typically be formed integral to and, accordingly, be manufactured of the same material as the body of the component; i.e. brass, steel, iron, etc. However, in other embodiments, the nipples 250 are separate pieces that are attached to the component body via art recognized means and, therefore, may be of a different material from that of the body of the component.

Figure 14:
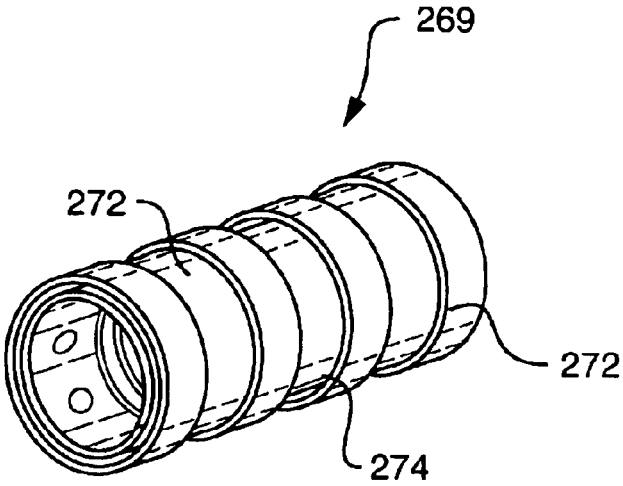
FIG. 14 is an isometric view of an alternative embodiment of a union coupler for use with a quick connect system.
Figure 15:
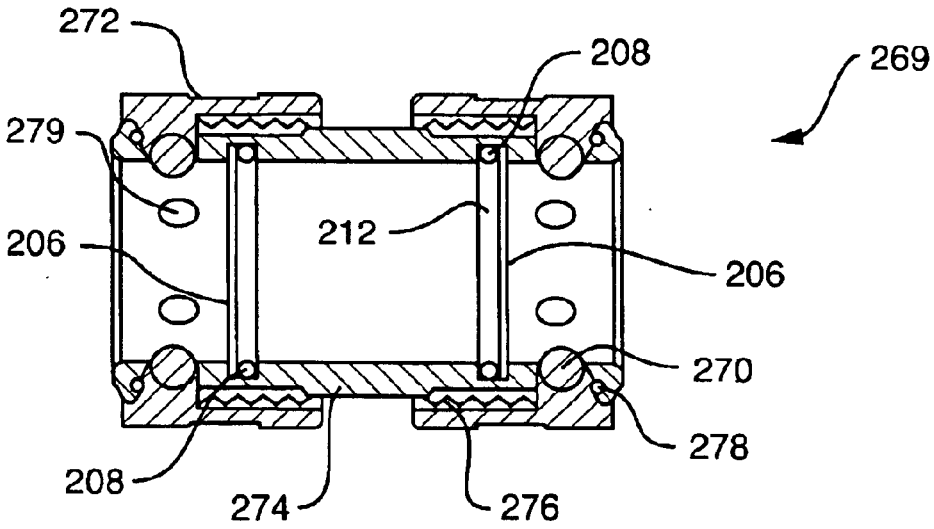
FIG. 15 is a cut away side view of the union coupler of FIG. 14.

Referring now to FIGS. 14 and 15, an alternative embodiment of the union coupler 269 is shown. This embodiment is similar to that coupler 201 in that the body 274 includes notches 212 to accommodate o-rings 208 and back up rings 286. However, the coupler 269 includes a pair of spring loaded collars 272 which operate in substantially the same manner as conventional pneumatic and/or hydraulic couplings. Each collar 272 is retained upon the body 274 by a spring 276, which exerts a force away from the body 274, and a split ring 278, which prevents the collar 272 from becoming disassembled from the body 274. Each collar includes a plurality of ball bearings 278, which are disposed along its circumference such that they will mate with openings 279 disposed through the body 274 along its circumference.

Figure 16:
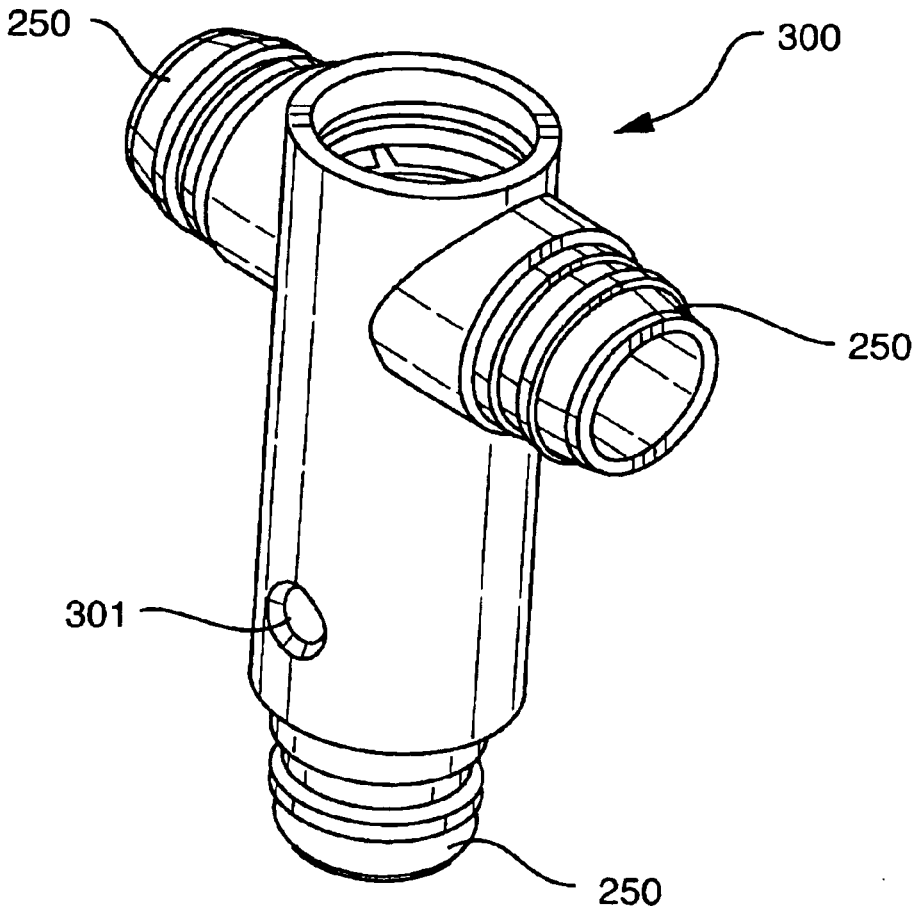
FIG. 16 is a side view of an improved tempering valve in accordance with the present invention.

Referring now to FIG. 16, a unique tempering valve 300, for use in connection with any of the above referenced embodiments of the system, is shown. Tempering valve 300 is unique because it includes an integral immersion well 301 that allows a temperature gauge (not shown) to be inserted therein for measuring the temperature of the fluid leaving the valve 300. The inclusion of such a well is an improvement over conventional valves as it eliminates the need for a separate temperature gauge downstream of the tempering valve, along with the associated tee's quick disconnects and the like. As shown in FIG. 16, the tempering valve of the present invention includes three nipples 250 designed for attachment to a union coupler 201 or 269 described above. However, it is recognized that other connection arrangements, such as those described herein, may be utilized.

Figure 17:
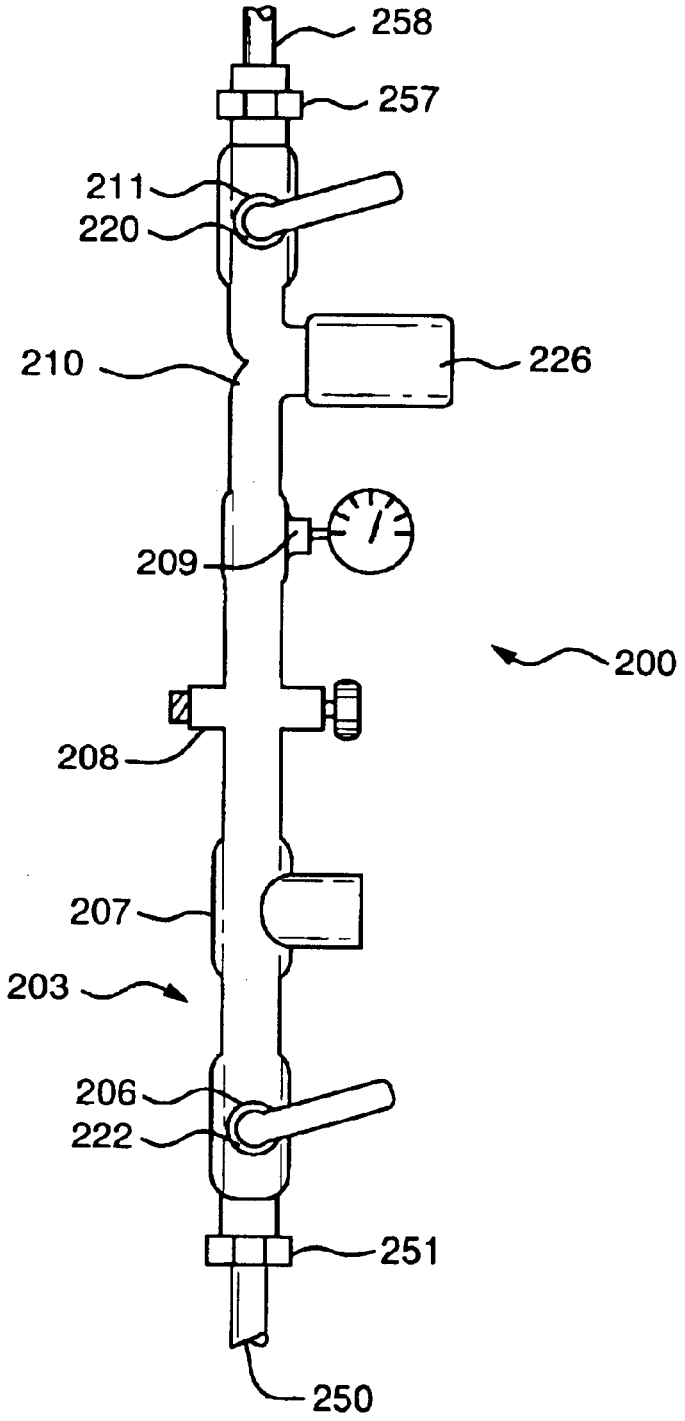
FIG. 17 is side view of the components of FIG. 2 formed together into an integrated flow system for a radiant hot water heating system.
Figure 18:
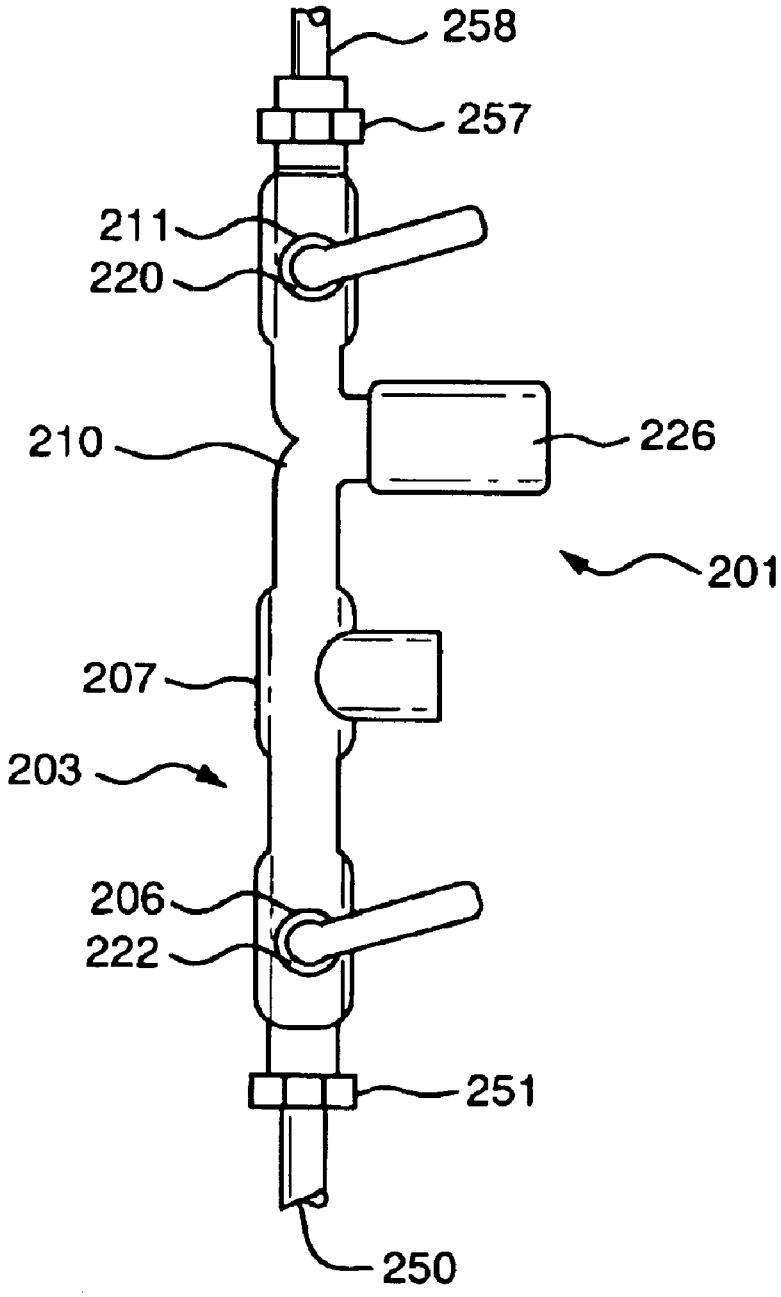
FIG. 18 is side view of the components of FIG. 2 formed together into an integrated flow system for a radiator type hot water heating system.

Referring now to FIGS. 17 and 18, two embodiments of an integrated flow system are shown in which flow components are formed together into a single unit having connectors at each end. These embodiments were developed in response the concern that the use of union connectors, or other quick release connectors, between components creates a large number of joints that could potentially leak at some time after installation. One benefit of present systems is that soldered and threaded joints are extremely rugged and, therefore, will rarely ever leak. In order to attempt to emulate this kind of "permanent" seal between components, the integrated flow systems of the present invention employ a molded or cast body into which several components are permanently attached together, with union or other quick release connectors attached only at the ends of the integrated system. This arrangement greatly reduces the risk of leakage, and reduces the overall complexity and time required to install a system.

The embodiment of FIG. 17 is an integrated flow system 200 that may be used to replace the multiple component arrangement of the embodiment of FIG. 2, which is used in radiant heating systems. The integrated flow system 200 of FIG. 17 includes a pair of connectors 251, 257 joins the body 203 of the system 200 to upstream heating components, for example to a connection pipe 250, 258 as shown. These connectors 251, 257 may be any of the union or quick disconnect type connectors described herein, or they may be adapted to mate with prior art soldered or threaded connectors. A first isolator valve 206 and second isolator valve 211 are preferably disposed within the body 200 of the system in order to provide isolation of the system 200 in the event that service is required on any of the components 207 208, 209, 210 of the system 200 after installation. However, it is understood that one or both of these valves 206, 211 may be eliminated, or may be separately attached to one of the connectors 251, 257 to achieve similar results. A tempering unit 208, temperature gauge 209, and circulator 210 are preferably disposed between the flow isolator valves 206, 211, with the body 203 forming the flow path between components.

In the preferred embodiment of the system, the body is molded, cast and/or machined to form a flow path having a plurality of openings disposed therein to accept the mechanical workings of each component. For example, the ends of the body 203 include threaded openings that accept the threaded innards 222, 220 of the isolator valves 206, 211, while the central portion includes an integrally formed volute to accept a replaceable cartridge 226 to form the circulator 210. Finally, as discussed above, an integrated tempering valve and temperature gauge may be utilized to replace the separate tempering valve 208 and temperature gauge 209.

The integrated flow system of FIG. 18 is similar to that of FIG. 17, except that it includes only those components necessary to replace the system of FIG. 4, which is used in radiator type hot water heating systems. Accordingly, the system 201 does not include the tempering valve 208 or temperature gauge 209, and could simply include the circulator 210 and flow control valve 207 formed integral to one another.

It is recognized that the concept of integrating multiple components into a single system may be applied to other of the components discloses herein. For example, the air scoop, or Microbubble vent, could incorporate a tee on the bottom where the expansion tank would otherwise connect, so that the automatic water feed, i.e. pressure reducing valve and backflow preventer could connect right there where present day wisdom dictates it should be located. Of course, it is recognized that the water feed and backflow would be one "module," too. Accordingly, the integrated flow system should not be seen as limited to the flow components shown in FIGS. 17 and 18.

Finally, it is noted that all of the components in any of the embodiments of the systems discussed herein need only be made of one internal flow diameter; preferably one inch. One inch is preferred, as no modem residential system needs anything larger than this size and having a single size reduces tooling and inventory costs, etc. Further, if more heat is required, another zone could be added to the manifolds.

Although the present invention has been described in considerable detail with reference to certain preferred versions thereof, other versions would be readily apparent to those of ordinary skill in the art. Therefore, the spirit and scope of the appended claims should not be limited to the description of the preferred versions contained herein.

What is claimed is:

1. A hot water heating system comprising:

a first isolator valve;

a flow control valve in fluid communication with said first isolator valve;

a circulator in fluid communication with said isolator valve and said flow control valve; and a second isolator valve in fluid communication with said first isolator valve, said flow control valve, and said circulator;

wherein each of said first isolator valve, said flow control valve, said circular and said second isolator valve comprise an inflow end and an outflow end;

wherein each inflow end comprises a first portion of a connector having a first sealing surface and each outflow end comprises a second portion of said connector having a second sealing surface;

wherein said first portion of each connector is dimensioned to mate with said second portion of each connector such that a first portion of said connector on one said first isolator valve, said flow control valve, said circular, and said second isolator valve may be mated with said second portion of said connector on an adjoining one of said first isolator valve, said flow control valve, said circulator, and said second isolator valve.

2. The hot water heating system of claim 1 wherein said connector is a union connector.

3. The hot water heating system of claim 2 wherein one of said first sealing surface and said second sealing surface further comprises an insert and wherein another of said first sealing surface and said second sealing surface is dimensioned to mate with said insert.

4. The hot water heating system of claim 3 wherein said insert is made of a resilient material.

5. The hot water heating system of claim 4 wherein said resilient material is selected from a group consisting of thermoplastic material, synthetic resinous fluorine, urethane, elastomeric material and rubber.

6. The hot water heating system of claim 5 wherein at least one of said first sealing surface and said second sealing surface is substantially conical in shape.

7. The hot water heating system of claim 5 wherein at least one of said first sealing surface and said second sealing surface is substantially spherical in shape.

8. The hot water heating system of claim 5 wherein said resilient material is synthetic resinous fluorine.

9. The hot water heating system of claim 8 wherein at least one of said first sealing surface and said second sealing surface is substantially conical in shape.

10. The hot water heating system of claim 8 wherein at least one of said first sealing surface and said second sealing surface is substantially spherical in shape.

11. The hot water heating system of claim 1 wherein said first portion of each connector and said second portion of each connector are dimensioned to form a quick connect-disconnect type coupling.

12. The hot water heating system of claim 11 wherein said quick connect-disconnect type coupling further comprises a secondary locking means to prevent accidental displacement of said coupling after assembly.

13. The hot water heating system of claim 12 wherein said union nut further comprises a knurled union nut dimensioned to allow installation and tightening of said union nut via direct manipulation by a human hand and without the use of a tool.

14. A connector system for coupling a first component and a second component of a hot water heating system, said connector system comprising:

a nipple having a locking nut and a sealing notch disposed thereon; and a union coupler comprising:

sealing means dimensioned to mate with said sealing notch of said nipple and creating a water-tight seal between said nipple and said union coupler;

a union body having a substantially hollow cylindrical cross section forming an outer wall and an inner wall, at least one notch for accepting said sealing means, and at least one slot disposed through said outer wall and said inner wall to form at least one opening across a circumference of said union body said at least one notch being disposed a distance from said at least one slot that is substantially identical to a distance between said sealing notch and said locking notch of said nipple;

a union clamp having a substantially hollow cylindrical cross section forming an outer wall and an inner wall having a diameter that is larger than a diameter of said other wall of union body, said union clamp comprising a slit through said outer wall and said inner wall of sufficient width to allow the inner diameter of the ring to be adjusted, means for retaining said union clamp in place relative to the union body, and at least one locking detail dimensioned for disposal within said at least one slot through said union body such so as to engage said locking notch of said nipple and prevent said nipple from moving relative to said union coupler.

15. An integrated flow system comprising:

a unitary body comprising an inflow end, an outflow end, a tempering valve opening, and a volute opening and a flow control valve opening disposed between said inflow end and said outflow end;

a circulator pump attached to said volute opening;

a flow control valve attached to said flow control valve opening; and a tempering valve disposed within said at least one tempering valve opening.

16. The integrated flow system of claim 15 wherein said body further comprises at least one isolator valve opening and wherein said system further comprises at least one isolator valve disposed within said at least one isolator valve opening.

17. The integrated flow system of claim 15 wherein said body further comprises a temperature gauge opening and wherein said system further comprises a temperature gauge disposed within said at least one temperature gauge opening.

* * * * *